US010322593B2

(12) United States Patent
Iioka

(10) Patent No.: US 10,322,593 B2
(45) Date of Patent: Jun. 18, 2019

(54) INK JET PRINTER AND MOVEMENT CONTROL METHOD FOR CARRIAGE

(71) Applicant: OKI Data Corporation, Tokyo (JP)

(72) Inventor: Yuzuru Iioka, Tokyo (JP)

(73) Assignee: OKI Data Corporation, Tokyo (JP)

( * ) Notice: Subject to any disclaimer, the term of this patent is extended or adjusted under 35 U.S.C. 154(b) by 0 days.

(21) Appl. No.: 15/691,403

(22) Filed: Aug. 30, 2017

(65) Prior Publication Data

US 2018/0072077 A1 Mar. 15, 2018

(30) Foreign Application Priority Data

Sep. 15, 2016 (JP) ..... 2016-180615

(51) Int. Cl.

| | |
|---|---|
| ***B41J 19/20*** | (2006.01) |
| ***B41J 25/00*** | (2006.01) |
| ***B41J 2/045*** | (2006.01) |
| *B41J 2/165* | (2006.01) |

(52) U.S. Cl.

CPC ..... *B41J 25/001* (2013.01); *B41J 2/04503* (2013.01); *B41J 2/04586* (2013.01); *B41J 19/202* (2013.01); *B41J 19/205* (2013.01); *B41J 19/207* (2013.01); *B41J 2/16517* (2013.01)

(58) Field of Classification Search

CPC ..... B41J 25/001; B41J 19/207; B41J 19/205; B41J 19/202; B41J 2/04503; B41J 2/04586; B41J 2/16517

See application file for complete search history.

(56) References Cited

U.S. PATENT DOCUMENTS

| | | | | |
|---|---|---|---|---|
| 8,882,375 | B2 * | 11/2014 | Katahira | B41J 11/42 400/616 |
| 2010/0067926 | A1 * | 3/2010 | Akiyama | B41J 11/006 399/21 |
| 2013/0194336 | A1 * | 8/2013 | Iwadate | B41J 23/00 347/14 |

FOREIGN PATENT DOCUMENTS

JP 2010-64442 A 3/2010

* cited by examiner

*Primary Examiner* — Sharon A. Polk

(74) *Attorney, Agent, or Firm* — Muncy, Geissler, Olds & Lowe, P.C.

(57) ABSTRACT

An inkjet printer includes a carriage motor that moves a carriage, a carriage driving part that drives the carriage motor, a control value calculating part that calculates a total control value (Wt) composed with a control value for a feedback control and a control value for a feedforward control, which are respectfully referred as a feedback control value (Wb) and a feedforward control value (Wf), and an abnormality judging part that judges whether an abnormality has occurred to the carriage movement based on whether a proportional component (Wp) of the feedback control value has exceeded a threshold value.

11 Claims, 9 Drawing Sheets

Fig. 3 *Prior Art*

INK JET PRINTER AND MOVEMENT CONTROL METHOD FOR CARRIAGE

TECHNICAL FIELD

This invention relates to an inkjet printer and a movement control method for a carriage.

BACKGROUND

Conventionally, an inkjet printer is designed to perform printing by moving a carriage in the main scanning direction, supplying ink from an ink cartridge to a recording head mounted on the carriage, ejecting ink droplets from the recording head and letting them adhere to (land on) a recording medium, thereby forming an image such as a character or picture consisting of multiple dots.

By the way, in moving the carriage in the inkjet printer, a target velocity that is the velocity targeted by the carriage is set as a target value, and the target velocity is categorized into an acceleration region where the carriage is accelerated from a stopped state, a uniform velocity region where the carriage is moved at a constant velocity, and a deceleration region where the carriage is decelerated and stopped.

In the uniform velocity region, by stably moving the carriage at a constant velocity, the tracks of ink droplets from their ejection from the recording head to their adhesion to the recording medium become uniform, and as the result, dots can be formed in target dot positions on the recording medium. However, if the carriage cannot be stably moved and unevenness occurs in its velocity for example, dots cannot be formed in their target dot positions on the recording medium, degrading the image quality.

Then, in the inkjet printer, feedback control is performed so that the carriage can stably move at a constant velocity in the uniform velocity region.

In the feedback control, based on the above-mentioned target velocity of the carriage, an actual velocity that is the actual velocity of the carriage, a gain, etc., control values including a proportional component and an integral component for the feedback, in other words, feedback control values, are calculated, and the feedback control values are supplied to a carriage driving part for driving the carriage, thereby performing carriage movement control so that the actual velocity becomes the target velocity.

By the way, if an abnormality occurs to the carriage movement, an image cannot be normally formed on the recording medium. For example, if the recording medium hits the carriage, causing a jam, the carriage cannot be moved, and an image cannot be formed on the recording medium. Also, if a foreign body enters inside a chassis of the inkjet printer, the recording medium could become warped, and if the warped recording medium hits the carriage, the carriage cannot be moved at a constant velocity, and dots cannot be formed in the target dot positions on the recoding medium, degrading the image quality.

Then, an inkjet printer has been offered, the inkjet printer being designed to judge whether a deviation between the target velocity and the actual velocity of the carriage has exceeded a threshold value, and if the deviation has exceeded the threshold value, judges that an abnormality has occurred to the carriage movement (see Patent Document 1 for example).

RELATED ART

Patent Document(s)

[Patent Doc. 1] JP Laid-Open Patent Publication 2010-64442

One Subject to be Solved

However, in the above-mentioned conventional inkjet printer, because carriage movement control is performed by feedback control, the actual velocity is delayed relative to the target velocity, and the deviation between the target velocity and the actual velocity becomes large, which could cause an error in judging whether an abnormality has occurred to the carriage movement.

Then, in order to judge accurately whether an abnormality has occurred to the carriage movement, one idea thought of is to increase the threshold value according to the above-mentioned deviation. However, if the threshold value is increased, when a minor abnormality such that the recording medium becomes distorted and slightly touches the carriage has occurred, the deviation may not exceed the threshold value. In that case, it becomes impossible to judge that an abnormality has occurred to the carriage movement.

As the result, blurring occurs in a formed image, degrading the image quality.

The objective of this invention is to offer an inkjet printer and a carriage movement control method that can solve the above-mentioned problem of the conventional inkjet printer and accurately judge whether an abnormality has occurred to the carriage movement.

SUMMARY

Considering the above objects, a controller of the invention controls a movement of carriage using not only a feedback value but a feedforward value also. Further, the feedback control value is composed with two components, which are a proportional component (Wp) and a integral component (Wi). Using the proportional component, the controller accurately determines if an abnormality of the carriage happens.

More specifically noted, an inkjet printer includes a carriage motor that moves a carriage, a carriage driving part that drives the carriage motor, a control value calculating part that calculates a total control value (Wt) composed with a control value for a feedback control and a control value for a feedforward control, which are respectfully referred as a feedback control value (Wb) and a feedforward control value (Wf), and an abnormality judging part that judges whether an abnormality has occurred to the carriage movement based on whether a proportional component (Wp) of the feedback control value has exceeded a threshold value.

In this case, because carriage movement control is performed using both feedback control and feedforward control, control values for feedback control can be decreased by the amount that control values for the feedforward control are calculated, and therefore the proportional component can be decreased.

Therefore, in judging whether the proportional component has exceeded the threshold value, because the threshold value can be decreased, even if the abnormality in the carriage movement is small, whether the proportional component has exceeded the threshold value can be securely judged.

As the result, whether an abnormality has occurred to the carriage movement can be accurately judged.

BRIEF DESCRIPTION OF THE DRAWINGS

FIGS. 3-5 are directed to prior art.

DETAILED DESCRIPTION OF PREFERRED EMBODIMENTS

Below, an embodiment of this invention is explained in details referring to drawings. In this case, an inkjet printer as an image forming apparatus of an inkjet system is explained.

Figure 2:
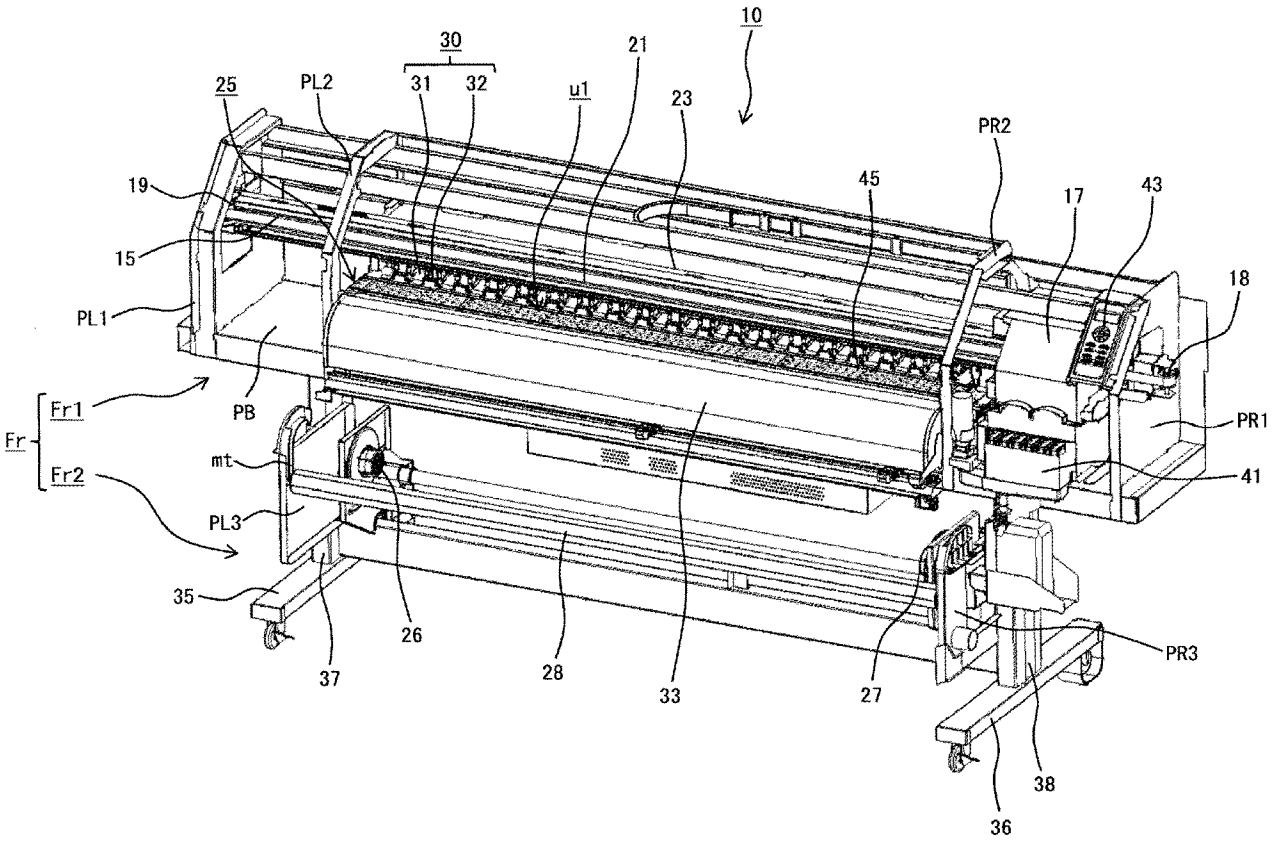
FIG. 2 is a perspective view of the inkjet printer in the embodiment of this invention.

FIG. 2 is a perspective view of the inkjet printer in the embodiment of this invention.

In the figure, indicated as 10 is the inkjet printer, Fr is a frame of the inkjet printer 10, and the frame Fr comprises an upper frame Fr1 and an under frame Fr2.

The above-mentioned upper frame Fr1 is provided with a receiving plate PB arranged extending from the left end to the right end when seen from the front side of the inkjet printer 10 (front side in the figure), an outer side plate PL1 as a first main supporting part formed standing up from the left end of the receiving plate PB, an outer side plate PR1 as a second main supporting part formed standing up from the right end of the receiving plate PB, an inner side plate PL2 as a first sub supporting part formed standing up from the receiving plate PB at a prescribed distance rightward of the above-mentioned outer side plate PL1, and an inner side plate PR2 as a second sub supporting part formed standing up from the receiving plate PB at a prescribed distance leftward of the above-mentioned outer side plate PR1.

Figure 1:
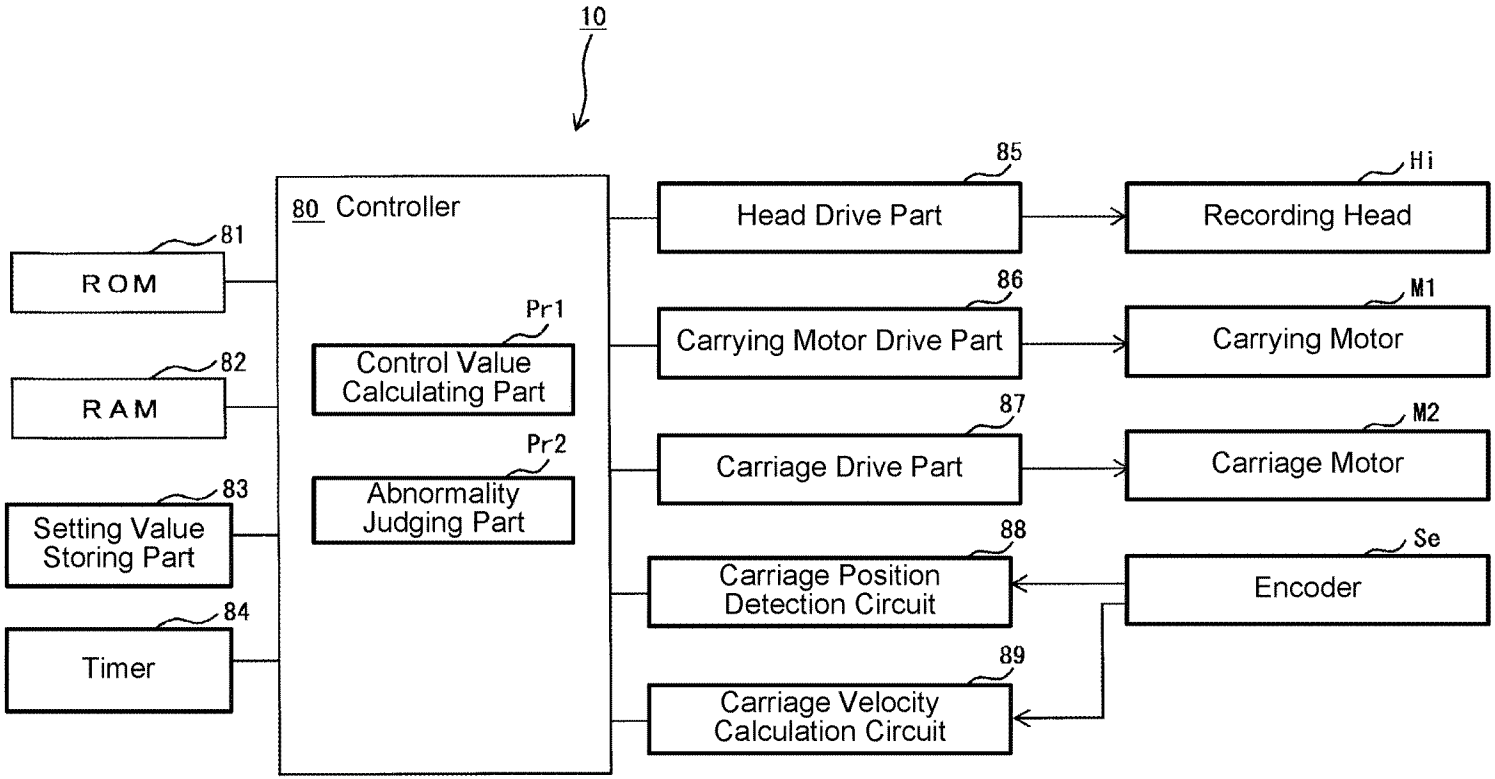
FIG. 1 is a block diagram showing a control device of an inkjet printer in an embodiment of this invention.

A rail 15 is erected between the above-mentioned outer side plates PL1 and PR1, and a carriage 17 is arranged in a freely movable manner in the left-right direction along the rail 15. Therefore, arranged in a freely rotatable manner are a driving-side pulley 18 on the above-mentioned outer side plate PR1 and a driven-side pulley 19 on the outer side plate PL1, an endless belt 21 is stretched in a freely travelable manner between the pulleys 18 and 19, and the carriage 17 is attached to a prescribed place of the endless belt 21. Then, connected to the above-mentioned pulley 18 is a below-mentioned carriage motor M2 (FIG. 1) as a drive part for moving the carriage. Also, attached to the above-mentioned carriage 17 are below-mentioned multiple, four in this embodiment, recording heads Hi (i=1, 2, . . . , 4) (FIG. 1).

Then, the carriage 17 is moved in the left-right direction (main scanning direction) by driving the above-mentioned carriage motor M2, and by the individual recording heads Hi being moved in the left-right direction accompanying the movement of the carriage 17, printing can be performed on an unshown recording medium.

In this embodiment, the above-mentioned recording heads Hi are recording heads of an inkjet system, where four recording heads Hi that eject black (Bk), yellow (Y), magenta (M), and cyan (C) ink droplets are mounted on the carriage 17 so that a color image can be formed. Note that the color reproducibility can be improved by using recording heads of other colors than the recording heads Hi of the above-mentioned colors. Also, used as an organic solvent as a solvent in this embodiment is a solvent ink containing a pigment as a colorant.

Unshown multiple nozzles are formed in an array shape on the nozzle face of each of the recording heads Hi, and a color image can be formed by attaching the recording heads Hi to the carriage 17 so that the nozzle faces oppose the recording medium, and having ink droplets of individual colors ejected through the nozzles according to image data and adhere onto target dot positions on the above-mentioned recording medium while reciprocating the carriage 17.

Note that as the recording medium, other than sheets of paper, films made of resins such as vinyl chloride and PET can be used, and the recording medium is carried in a direction perpendicular to the moving direction of the carriage 17.

Also, a linear scale 23 is arranged along the above-mentioned rail 15, and by reading the divisions of the linear scale 23 using a below-mentioned encoder Se (FIG. 1) arranged on the carriage 17, the position of the carriage 17 can be detected.

Then, a medium center guiding part 25 is arranged between the inner side plates PL2 and PR2 on the above-mentioned receiving plate PB. The medium center guiding part 25 is provided with a platen unit u1 as a supporting unit that is arranged extending between the inner side plates PL2 and PR2, has a plate shape, and supports the recording medium, and an unshown air suction mechanism for drawing from below the recording medium carried on the platen unit u1 toward the platen unit u1 side with a negative pressure.

The above-mentioned platen unit u1 is provided with a platen 45 as a supporting member having a plate shape, an unshown linear heater that is laid on the rear face of the platen 45 and heats the recording medium by heating the platen 45, and an unshown platen cover as a covering member that has a plate shape, is attached to the rear face of the platen 45, and covers the above-mentioned heater.

When the platen 45 is heated by the above-mentioned heater to make the platen 45 become a constant temperature, the recording medium carried on the platen 45 is heated. In this case, by making the temperature of the platen 45 uniform, an image of uniform quality can be formed. Also, by maintaining the temperature of the recording medium at the most appropriate temperature according to the property of the recording medium and the properties of the inks, ink droplets can be let adhere well to the recording medium, and thus the image quality can be enhanced. If there is unevenness in temperature of the recording medium, differences in drying speed of the individual ink droplets cause differences in their wetting and spreading, and as the result, differences in fusability occur, thereby a specific pattern such as a linear one occurs on the image, degrading the image quality. Furthermore, if the temperature of the platen 45 is too high, the recording medium becomes warped, making it impossible to carry the recording medium stably.

Also, multiple suction holes are formed on the platen 45, a suction chamber is arranged in the above-mentioned air suction mechanism, and a fan is arranged on the suction chamber. By exhausting air inside the suction chamber with the fan and generating a negative pressure in the suction chamber, air can be sucked through each of the suction holes, and the recording medium can be drawn toward the platen unit u1 side.

On the rear side (deeper side in the figure) of the above-mentioned upper frame Fr1, an unshown rear paper guide as a medium rear guiding part is arranged. The rear paper guide guides the recording medium, that is forwarded from an unshown forwarding roll and carried up, to the above-mentioned medium center guiding part 25. Therefore, between the above-mentioned rear paper guide and the medium center guiding part 25 in the carrying direction of the recording medium, a carrying roller pair 30 as a carrying member is arranged in a freely rotatable manner.

The carrying roller pair 30 comprises a carrying roller 31 as a first roller arranged in a freely rotatable manner extending along the platen unit u1, and multiple pinch rollers 32 as second rollers that are arranged in a freely rotatable manner above the carrying roller 31 and press the recording medium onto the carrying roller 31. Once a below-mentioned carrying motor M1 as a drive part for carrying is driven to rotate the carrying roller 31, the individual pinch rollers 32 are rotated by drag turning, thereby the recording medium is forwarded from the forwarding roll and carried in a state sandwiched between the carrying roller 31 and the individual pinch rollers 32. Note that the above-mentioned individual pinch rollers 32 are supported in a freely swingable manner by an unshown arm, and each of them is independently biased toward the carrying roller 31 by an unshown spring as a bias member, constituting a pinch roller unit.

In this case, the above-mentioned carrying motor M1 is driven to carry the recording medium by a prescribed distance, afterwards the carrying motor is stopped, the carriage 17 is moved in that state, and ink droplets of individual colors are ejected from the individual recording heads Hi, thereby one scan is performed to form one line of image. Once one scan is finished, the above-mentioned carrying motor M1 is driven again to carry the recording medium by a prescribed distance, afterwards the carrying motor M1 is stopped, the carriage 17 is moved in that state, and ink droplets are ejected from the individual recording heads Hi, thereby performing one scan and forming one line of image. By repeating this operation, an image is formed on the recording medium.

Note that although printing is performed by a single-pass system in this embodiment, if printing is performed by a multi-pass system, the distance to carry the above-mentioned recording medium is made shorter than the nozzle array of the recording head Hi, and one line of image is formed by performing multiple scans.

Arranged on the front side of the above-mentioned upper frame Fr1 is a front paper guide 33 as a medium front guiding part for guiding the recording medium after printing is performed. The front paper guide 33 has a curved shape for guiding downwards the recording medium ejected horizontally from the above-mentioned medium center guiding part 25. Note that an unshown heater is arranged on the rear face of the above-mentioned front paper guide 33, and the front paper guide 33 is heated by the heater to heat the recording medium.

The above-mentioned under frame Fr2 is provided with pedestals 35 and 36 arranged in parallel at a prescribed distance between the left-end vicinity and the right-end vicinity of the inkjet printer 10, props 37 and 38 formed standing up from the center of the respective pedestals 35 and 36, and holding plates PL3 and PR3 attached to the respective props 37 and 38.

Between the holding plates PL3 and PR3, an unshown paper tube (winding roll) is arranged in a freely rotatable manner for winding the recording medium that is ejected from the medium center guiding part 25 and guided by the above-mentioned front paper guide 33. In order to hold the paper tube at the left end and the right end, roll bearings 26 and 27 are arranged in a freely rotatable manner on the above-mentioned holding plates PL3 and PR3, respectively. By rotating the above-mentioned paper tube by an unshown winding device, the recording medium can be wound.

Also, in the front side of the above-mentioned paper tube, a tension roller 28 is arranged in a freely movable manner in the up-down direction extending between the holding plates PL3 and PR3. The tension roller 28 gives tension to the recording medium that is guided by the front paper guide 33 and wound up by the paper tube so that the recording medium should not develop any slack. Therefore, a groove mt is formed extending in the up-down direction on the inner face of each of the above-mentioned holding plates PL3 and PR3, and the tension roller 28 is moved in the up-down direction along the grooves mt.

By the way, as mentioned above, in this embodiment, the above-mentioned rail 15 is erected between the outer side plates PL1 and PR1, and the medium center guiding part 25 is arranged between the inner side plates PL2 and PR2.

Therefore, printing by the individual recording heads Hi is performed while the carriage 17 is being moved over the medium center guiding part 25, and printing by the individual recording heads Hi is not performed while the carriage 17 is placed between the outer side plate PL1 and the inner side plate PL2 or between the outer side plate PR1 and the inner side plate PR2.

Then, in this embodiment, the space between the outer side plate PR1 and the inner side plate PR2 is made a home position for performing the origin adjustment of the position of the carriage 17 and performing the maintenance of the individual recording heads Hi, and the space between the outer side plate PL1 and the inner side plate PL2 is made a retreat position for letting the carriage 17 retreat from over the medium center guiding part 25.

Then, in the above-mentioned home position, a maintenance unit 41 is arranged opposing the individual recording heads Hi, and an operation panel 43 is arranged as an operation/display part for operating the inkjet printer 10. In order to maintain the nozzles of the recording heads Hi in a fine state, the above-mentioned maintenance unit 41 is provided with a wiper to wipe the nozzle face of each of the recording heads Hi, a cap to prevent drying of the nozzles, a suction mechanism to suck ink whose viscosity increased inside a nozzle, etc. Also, the above-mentioned operation panel 43 is provided with an operation part where operation buttons etc. are arranged, and a display part where a display lamp etc. are arranged.

Next, explained is the control device of the above-mentioned inkjet printer 10.

FIG. 1 is a block diagram showing the control device of the inkjet printer in the embodiment of this invention.

In the figure, indicated as 80 is a controller that controls the whole inkjet printer 10, 81 is ROM as a first memory part that records a control program, initial values, etc., and 82 is RAM as a second memory part used as a work area for the controller 80 to perform arithmetic operations and also as a buffer for temporarily recording various kinds of data.

Also, indicated as 83 is a setting value storing part as a third memory part for recording various kinds of setting values in the inkjet printer 10. Recorded in the setting value storing part 83 are target values in moving the carriage 17 such as target velocity Vs of the carriage 17 and target position of the carriage 17 at every unit time (every 1 ms in this embodiment), and a control value for below-mentioned feedforward control, that is, a feedforward control value Wf at every unit time. The individual target values are set by performing experiments or the like in advance. Note that because movement control of the carriage 17 is performed at every unit time, the shorter the unit time that regulates the individual setting values, the better trackability to the target velocity Vs can become.

Furthermore, recorded in the above-mentioned setting value storing part 83 are threshold values εj (j=1, 2, 3) for judging whether an abnormality has occurred to the movement of the carriage 17. The threshold values εj are set differently according to the peak values of the proportional component Wp in the acceleration region, the uniform velocity region, and the deceleration region of the target velocity Vs, and recorded in the setting value storing part 83.

Note that in this embodiment, in order to judge whether an abnormality has occurred to the movement of the carriage 17, it is judged whether the proportional component Wp calculated based on the deviation between the target position and the actual position of the carriage 17, the deviation between the target velocity Vs and the actual velocity of the carriage 17, the gain, etc. has exceeded the threshold value εj (whether the proportional component Wp is greater than the threshold value εj). If delays occur in the actual position and the actual velocity of the carriage 17, thus the deviation between the target position and the actual position of the carriage 17 and the deviation between the target velocity Vs and the actual velocity of the carriage 17 increase, because the proportional component Wp also increases, it is possible to judge whether an abnormality has occurred to the movement of the carriage 17 based on whether the proportional component Wp has exceeded the threshold value εj.

Then, indicated as 84 is a timer as a clocking part that is operated by the controller 80 and measures time as time information.

The above-mentioned controller 80 is provided with a control value calculating part Pr1 and an abnormality judging part Pr2, and following the control program recorded in the above-mentioned ROM 81, an unshown CPU of the controller 80 operates the control value calculating part Pr1 and the abnormality judging part Pr2 mentioned above, and also operates a head driving part 85, a carrying motor driving part 86, a carriage driving part 87, a carriage position detection circuit 88 as a carriage position detecting part, a carriage velocity calculation circuit 89 as a carriage velocity detecting part, etc. to perform various kinds of processes. One of the carriage position detection part and the carriage velocity detection part or both of these parts function as a carriage detection part. The carriage detection part functions to detect an actual status of the carriage. The actual status means an indicator to represent the actual status of the carriage, and may be composed with an actual position, an actual velocity and/or an actual travel time f the carriage, which are measured at a certain moment.

The above-mentioned head driving part 85 drives the recording heads Hi according to print data to have ink droplets ejected from the recording heads Hi.

Also, the above-mentioned carrying motor driving part 86 drives the carrying motor M1 to rotate the carrying roller 31, thereby carrying the recording medium, and the above-mentioned carriage driving part 87 drives the carriage motor M2 to move the carriage 17 in the main scanning direction.

Then, the above-mentioned carriage position detection circuit 88 reads the divisions of the linear scale 23 with the encoder Se, thereby detecting the actual position of the carriage 17 as position information, the above-mentioned carriage velocity calculation circuit 89 calculates the period of a signal output from the encoder Se and divide the distance between the divisions of the linear scale 23 by the period of the signal, thereby calculating the actual velocity of the carriage 17 and detecting it as velocity information. Therefore, the above-mentioned actual position is the position detected by the carriage position detection circuit 88, and the actual velocity is the velocity detected by the carriage velocity calculation circuit 89.

Note that although in this embodiment the actual velocity Vr of the carriage is detected by dividing the distance between the divisions of the linear scale 23 by the period of the signal, the moving distance of the carriage 17 can be calculated based on the position of the carriage 17 detected last time and the position of the carriage 17 detected this time by the carriage position detection circuit 88, elapsed time can be calculated based on the time when the position of the carriage 17 was detected last time and the time when the position of the carriage 17 is detected this time, and the actual velocity of the carriage 17 can be calculated by dividing the moving distance by the elapsed time.

Next, explained is an example of movement control of the carriage 17.

First, explained is the operation of the inkjet printer 10 when carriage movement control is performed using feedback control only.

Figure 3:
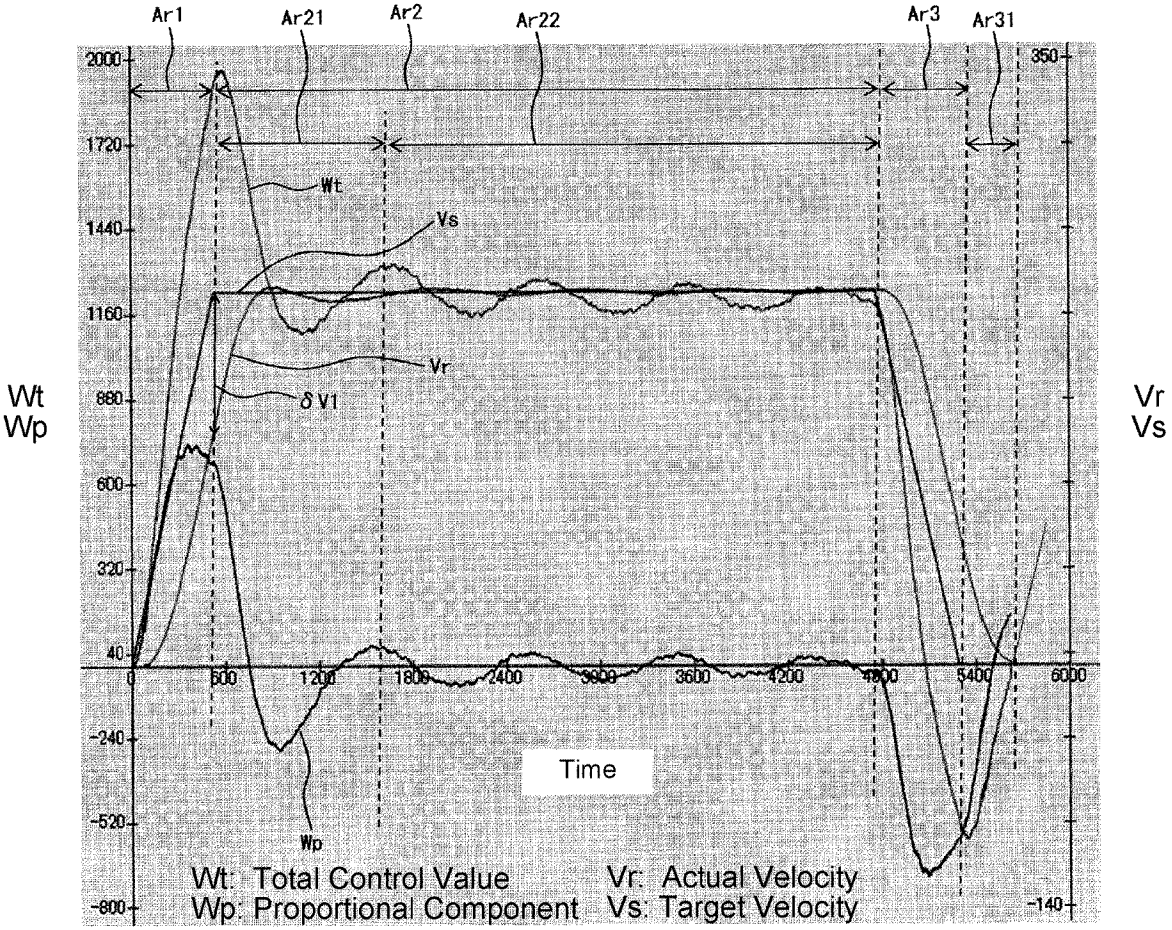
FIG. 3 is a time chart for explaining the operation of the inkjet printer when carriage movement control is performed using feedback control only.

FIG. 3 is a time chart for explaining the operation of the inkjet printer when carriage movement control is performed using feedback control only. Note that the horizontal axis indicates time (unit: ms), the left vertical axis the proportional component Wp and a total control value (final control value) Wt that is the final control value, and the right vertical axis the target velocity Vs and the actual velocity Vr. Also, the proportional component Wp, the total control value Wt, the target velocity Vs, and the actual velocity Vr are dimensionless quantities.

In the figure, indicated as Ar1 is the acceleration region where the carriage 17 is accelerated from a stopped state, Ar2 is the uniform velocity region where the carriage 17 is moved at a constant velocity, and Ar3 is the deceleration region where the carriage 17 is decelerated and stopped. Note that the acceleration region Ar1, the uniform velocity region Ar2, and the deceleration region Ar3 are all categorized by preset changes of the target velocity Vs, where the target velocity Vs is increased at a constant slope (or constant rate) from 0 to a prescribed value in the acceleration region Ar1, maintained at the above-mentioned prescribed value in the uniform velocity region Ar2, and decreased at a constant slope from the above-mentioned prescribed value to 0 in the deceleration region Ar3.

In this case, because movement control of the carriage 17 is performed using feedback control only, and the feedback control is performed with PI control, the total control value Wt is equal to a control value for feedback control, that is, a feedback control value Wb, which becomes the proportional component Wp with an unshown integral component Wi added and can be expressed as $$Wt=Wb=Wp+Wi$$

Note that the proportional component Wp constitutes a proportional element control value in the feedback control value Wb, and the integral component Wi an integral element control value in the feedback control value Wb. Also, because the integral component Wi has smaller variation than the proportional component Wp, it is not shown in FIG. 3.

By the way, the above-mentioned total control value Wt is a command value for driving the carriage motor M2, and upon calculating the above-mentioned total control value Wt, the controller 80 sends it to the carriage driving part 87. The carriage driving part 87 is provided with an unshown pulse width modulation signal generating part and a switching circuit, and upon receiving the total control value Wt, has a PWM control signal according to the total control value Wt generated in the above-mentioned pulse width modulation signal generating part, has current according to the duty of the PWM control signal generated in the above-mentioned switching circuit, and sends the current to the carriage motor M2 to drive the carriage motor M2. In this case, the greater the above-mentioned total control value Wt is, the greater the value of the current sent to the carriage motor M2 becomes, and the smaller the above-mentioned total control value Wt is, the smaller the value of the current sent to the carriage motor M2 becomes.

In feedback control, based on the actual position and the actual velocity Vr of the carriage 17 detected at the current timing, the feedback control value Wb is calculated at the next timing, and the carriage motor M2 is driven based on the feedback control value Wb, therefore delays in the actual position relative to the target position and in the actual velocity Vr relative to the target velocity Vs occur.

For example, as shown in the figure, when the target velocity Vs is in the acceleration region Ar1, separation between the target velocity Vr and the actual velocity Vs, that is, deviation δV gradually increases, and at the timing when the target velocity Vs shifts from the acceleration region Ar1 to the uniform velocity region Ar2, it becomes an extremely large value δV1, thereby trackability to the target velocity Vs declines.

Therefore, after the target velocity Vs shifted to the uniform velocity region Ar2, prescribed time becomes necessary until the delays in the actual position and the actual velocity Vr are dissolved and the actual velocity Vr becomes the target velocity Vs in the uniform velocity region Ar2, and during that time ink droplets cannot be ejected from the recording heads Hi. That is, a first waiting region Ar21 is formed for waiting until it becomes possible to eject ink droplets form the recording heads Hi, and during that time the carriage 17 is uselessly moved. Accompanying it, a print region Ar22 where actual printing is possible becomes fairly shorter than the uniform velocity region Ar2.

Also, after the target velocity Vs shifted from the uniform velocity region Ar2 to the deceleration region Ar3, when it has become 0, prescribed time becomes necessary until the actual velocity Vr becomes 0, and during that time the carriage 17 need be moved continuously. That is, a second waiting region Ar31 is formed for waiting for the actual velocity Vr to become 0, and during that time the carriage 17 is uselessly moved.

In this manner, if movement control of the carriage 17 is performed using feedback control only, delays in the actual position relative to the target position and in the actual velocity Vr relative to the target velocity Vs occur, thereby trackability to the target velocity Vs declines. Therefore, for example, in order to have the carriage 17 shift from the acceleration region Ar1 to the uniform velocity region Ar2 or from the uniform velocity region Ar2 to the deceleration region Ar3, necessity to perform excess control such as providing an excess margin occurs, thereby the movement time, one-scan distance, etc. of the carriage become longer, worsening the printing throughput.

Next, explained are changes in the proportional component Wp while performing movement control of the carriage 17 using feedback control only if no abnormality has occurred to the movement of the carriage 17, or if an abnormality has occurred to the movement of the carriage 17.

Figure 4:
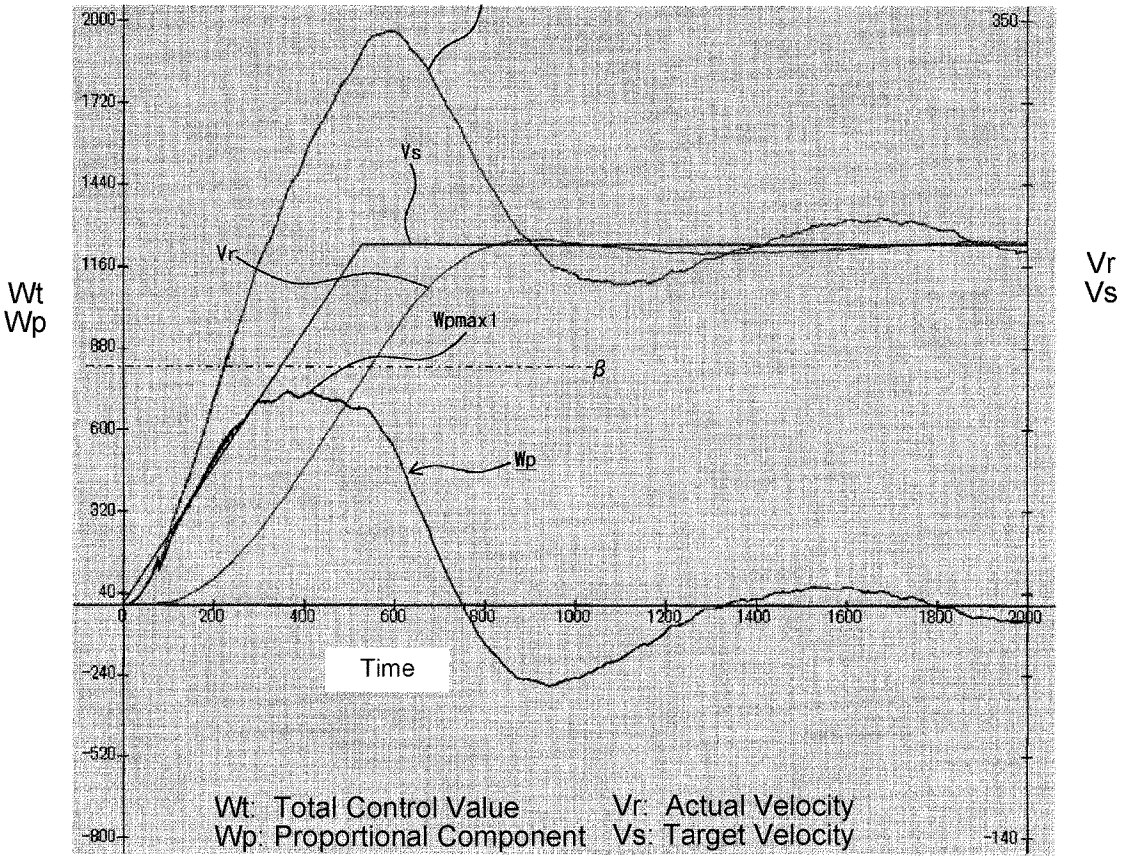
Fig. 4 Prior Art
FIG. 4 is a time chart for explaining the operation of the inkjet printer if no abnormality has occurred to the carriage movement while performing carriage movement control using feedback control only.
Figure 5:
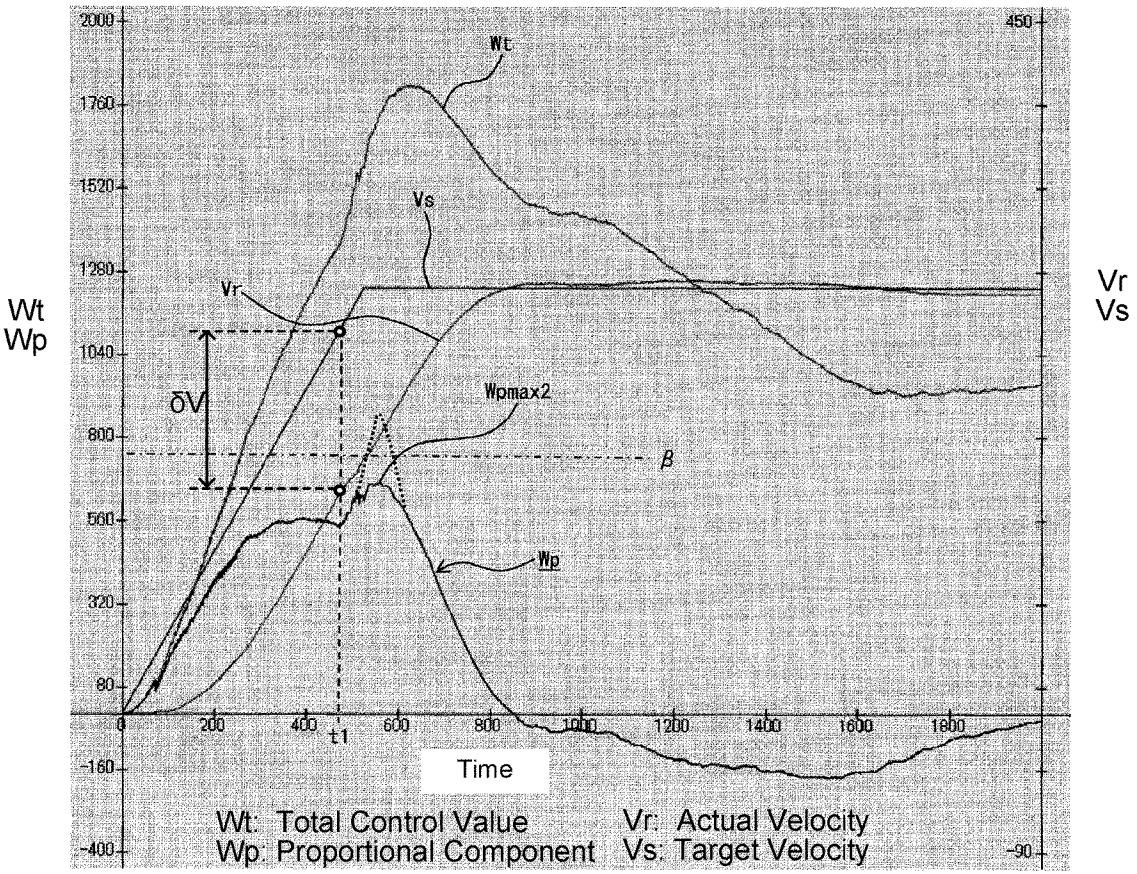
Fig. 5 Prior Art
FIG. 5 is a time chart for explaining the operation of the inkjet printer if an abnormality has occurred to the carriage movement while performing carriage movement control using feedback control only. The above

FIG. 4 is a time chart for explaining the operation of the inkjet printer if no abnormality has occurred to the carriage movement while performing carriage movement control using feedback control only, and FIG. 5 is a time chart for explaining the operation of the inkjet printer if an abnormality has occurred to the carriage movement while performing carriage movement control using feedback control only. Note that the horizontal axis indicates time (unit: ms), the left vertical axis the proportional component Wp and the total control value Wt, and the right vertical axis the target velocity Vs and the actual velocity Vr.

In the figure, indicated as Vs is the target velocity, Vr is the actual velocity, Wp is the proportional component, and Wt is the total control value. The proportional component Wp is calculated based on the deviation between the target position and the actual position, the deviation δV between the target velocity Vs and the actual velocity Vr, the gain, etc. Relationships between the deviation values and the control values, which correspond to the deviation values, are determined in advance and stored in ROM 81. For example, an equation for obtaining a control value corresponding to a deviation value, or a table in which control values and corresponding deviation values are aligned are stored in ROM 81. The control part 80 obtains an intended control value Wp by a calculation using a target value and a deviation value obtained from an actual measured value.

When the target velocity Vs is in the acceleration region Ar1 (FIG. 3), and if no abnormality has occurred to the movement of the carriage 17, as shown in FIG. 4, the proportional component Wp gradually increases according to delays occurring in the actual position and the actual velocity Vr, and after reaching a peak value Wpmax1, gradually decreases. In this case, because the peak value Wpmax1 never exceeds a threshold value β, it is not judged that an abnormality has occurred to the movement of the carriage 17.

As opposed to this, as shown in FIG. 5, if an abnormality occurs to the movement of the carriage 17 at timing t1, the actual velocity Vr of the carriage 17 decreases, the deviation δV increases, and accompanying it, the proportional component Wp increases.

At this time, if the abnormality in the movement of the carriage 17 is a small one to the extent that the recording medium is distorted and slightly touches the carriage, a peak value Wpmax2 of the proportional component Wp never exceeds the threshold value β, therefore it is not judged that an abnormality has occurred to the movement of the carriage 17.

On the other hand, if the movement of the carriage 17 is greatly delayed as in the case where the recording medium has hit the carriage and caused a jam, the proportional component Wp becomes large and exceeds the threshold value β as shown in a broken line, therefore it is judged that an abnormality has occurred to the movement of the carriage 17.

Based on this, this embodiment is designed so that the proportional component Wp is suppressed not to increase beyond the threshold value β, and that it is accurately judged whether an abnormality has occurred to the movement of the carriage 17.

Figure 6:
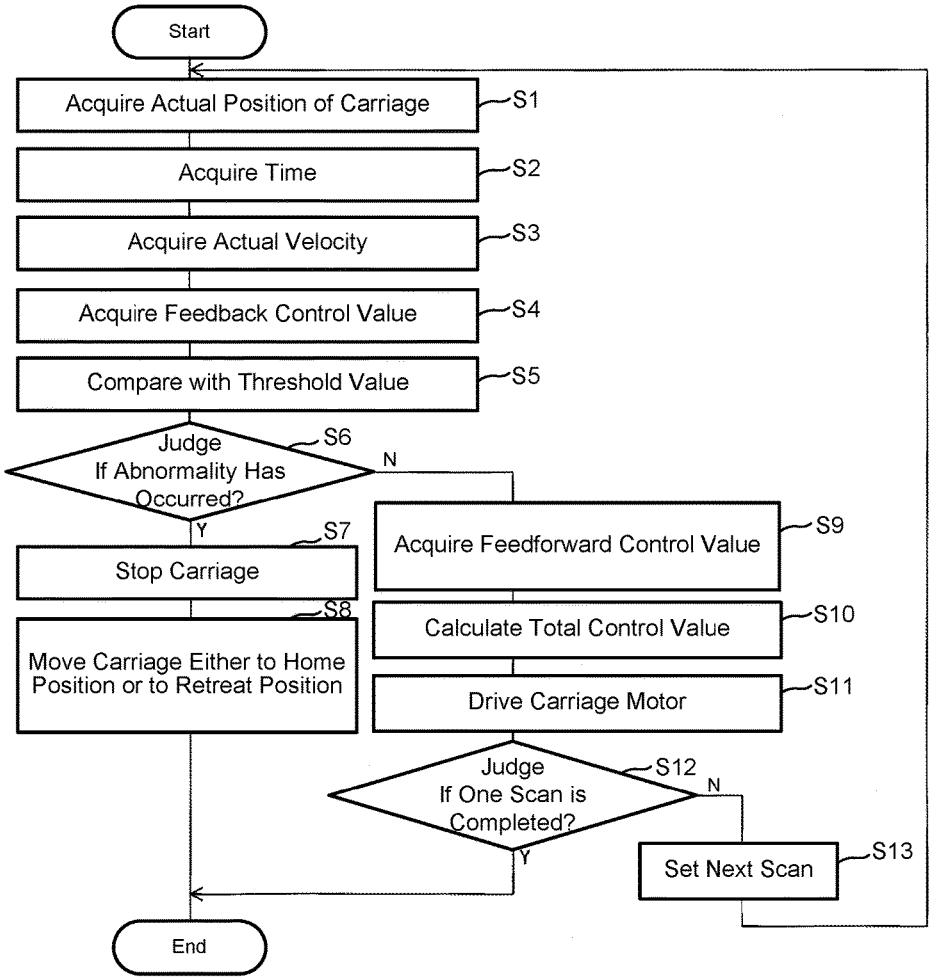
FIG. 6 is a flow chart showing the operation of the inkjet printer in the embodiment of this invention.
Figure 7:
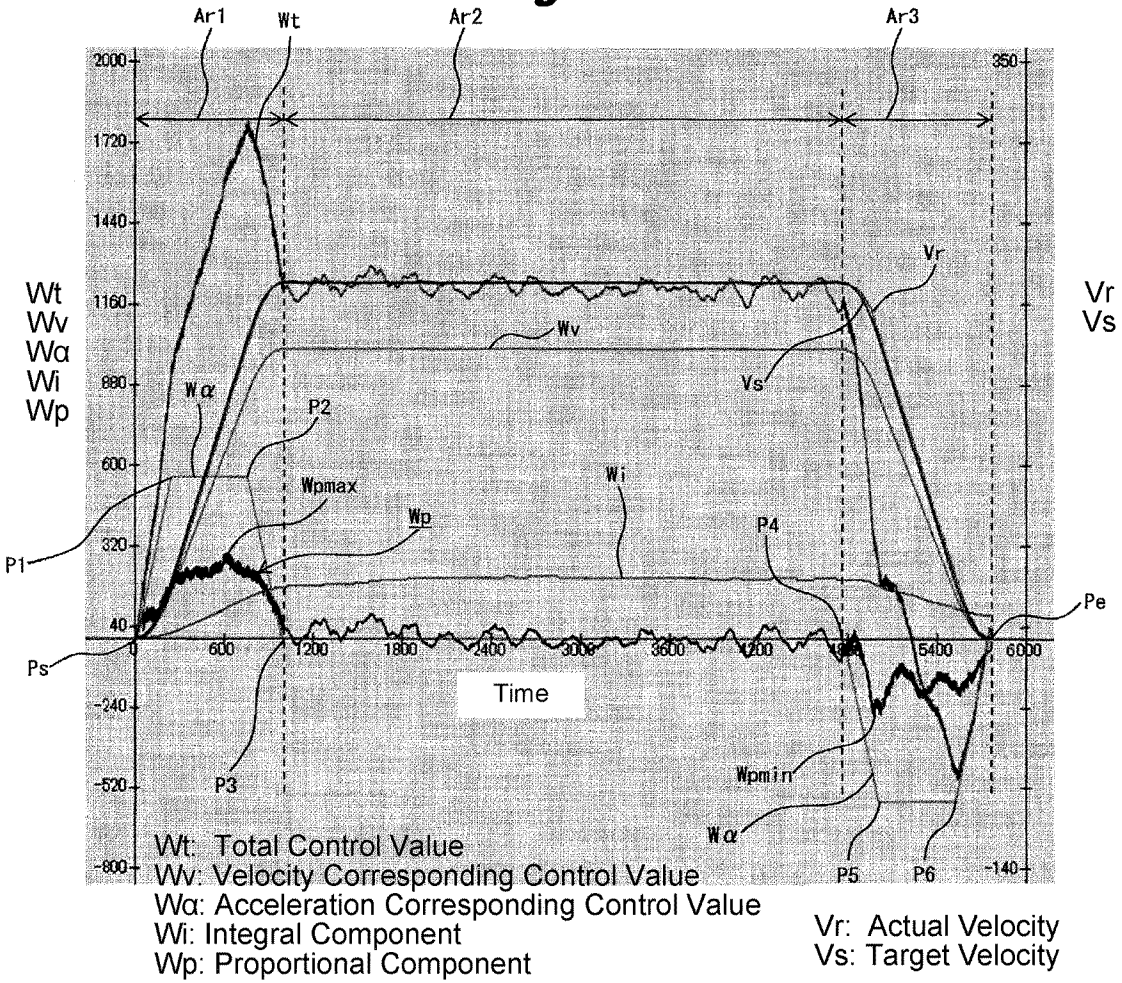
FIG. 7 is a time chart for explaining the operation of the inkjet printer when performing carriage movement control in the embodiment of this invention.

FIG. 6 is a flow chart showing the operation of the inkjet printer in the embodiment of this invention, and FIG. 7 is a time chart for explaining the operation of the inkjet printer when performing carriage movement control in the embodiment of this invention. Note that in FIG. 7, the horizontal axis indicates time (unit: ms), the left vertical axis the proportional component Wp, the integral component Wi, an acceleration corresponding control value Wα, a velocity corresponding control value Wv, and the total control value Wt, and the right vertical axis the target velocity Vs and the actual velocity Vr. Also, the proportional component Wp, the integral component Wi, the acceleration corresponding control value Wα, the velocity corresponding control value Wv, the total control value Wt, and the target velocity Vs and the actual velocity Vr of the carriage 17 are dimensionless quantities.

In this embodiment, the carriage 17 is designed to be reciprocated. In this case, explained here is a one-scan process of the carriage 17 when moving the carriage 17 from a starting point Ps for turning back the carriage 17 in the home position side toward (or to) an ending point Pe for turning back the carriage 17 in the retreat position side shown in FIG. 7. Because a one-scan process when moving the carriage 17 from the ending point Pe to the starting point Ps is the same except having the moving direction of the carriage 17 reversed, its explanation is omitted.

First of all, the controller 80 (FIG. 1) reads and acquires the actual position of the carriage 17 detected by the carriage position detection circuit 88.

Subsequently, the controller 80 reads and acquires time measured by the timer 84. In this case, the time measured by the timer 84 is regarded as elapsed time while the carriage 17 moves from the starting point Ps to the ending point Pe.

Then, the controller 80 reads and acquires the actual velocity Vr of the carriage 17 that is calculated and detected by the carriage velocity calculation circuit 89.

Next, the control value calculating part Pr1 of the controller 80 calculates the feedback control value Wb. In this case, because feedback control is performed with PI control, the feedback control value Wb becomes a value that is the proportional component Wp with the integral component Wi added, that can be expressed as $$Wb=Wp+Wi$$

In this embodiment, the proportional component Wp and the integral component Wi are calculated based on the deviation between the target position and the actual position and the deviation between the target velocity Vs and the actual velocity Vr of the carriage 17, the gain, etc. so that the actual position becomes the target position and the actual velocity Vr the target velocity Vs.

Therefore, the above-mentioned control value calculating part Pr1 reads the target velocity Vs and the target position from the setting value storing part 83, calculates the deviation between the target position and the actual position and the deviation δV between the target velocity Vs and the actual velocity Vr, and calculates the proportional component Wp and the integral component Wi.

By the way, the target velocity Vs in this embodiment is set to change as shown in FIG. 7, which is made different from the target velocity Vs when movement control of the carriage 17 is performed using feedback control only as shown in FIGS. 3-5.

Then, set for the above-mentioned target velocity Vs are the acceleration region Ar1 where the carriage 17 is accelerated from a stopped state, the uniform velocity region Ar2 where the carriage 17 is moved at a constant velocity, and the deceleration region Ar3 where the carriage 17 is decelerated and stopped.

The above-mentioned acceleration region Ar1 consists of a first acceleration region portion from the starting point Ps to an intermediate point P1 where the actual velocity Vr is increased by gradually increasing the target acceleration of the carriage 17, that is, target acceleration, in this case positive target acceleration, from the state where the carriage 17 is stopped, a second acceleration region portion from the intermediate point P1 to an intermediate point P2 where the actual velocity Vr is increased by maintaining the positive target acceleration at a constant value, and a third acceleration region portion from the intermediate point P2 to an intermediate point P3 where the actual velocity Vr is increased by gradually decreasing the positive target acceleration, and once the third acceleration region portion is finished, a shift occurs from the acceleration region Ar1 to the uniform velocity region Ar2, where the target velocity Vs is kept constant.

Then, the deceleration region Ar3 consists of a first deceleration region portion from an intermediate point P4 to an intermediate point P5 where the actual velocity Vr is decreased from the target velocity Vs by gradually decreasing (increasing in the absolute value) negative target acceleration, a second deceleration region portion from the intermediate point P5 to an intermediate point P6 where the actual velocity Vr is decreased by maintaining the negative target acceleration at a constant value, and a third deceleration region portion from the intermediate point P6 to the ending point Pe where the actual velocity Vr is decreased by gradually increasing (decreasing in the absolute value) the negative target acceleration, and once the third deceleration region portion is finished, the carriage 17 is stopped.

Figure 8:
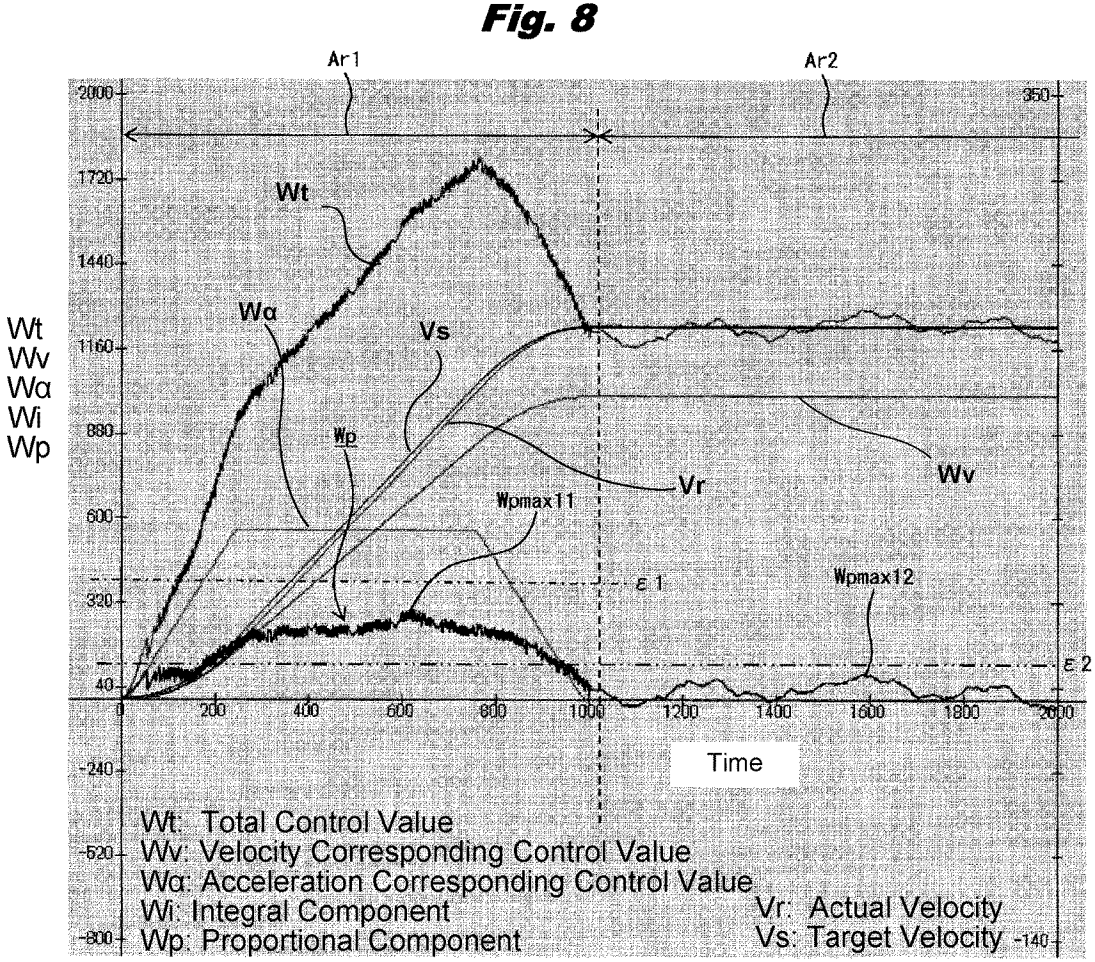
FIG. 8 is a time chart for explaining the operation of the inkjet printer if no abnormality has occurred to the carriage movement while performing carriage movement control in the embodiment of this invention.

Subsequently, the abnormality judging part Pr2 of the controller 80 reads the threshold value εj corresponding to each region of the acceleration region Ar1, the uniform velocity region Ar2, and the deceleration region Ar3 mentioned above for the target velocity Vs, compares the proportional component Wp and the threshold value εj, and judges whether an abnormality has occurred to the movement of the carriage 17 based on whether the proportional component Wp has exceeded the threshold value εj. Threshold value ε1 is shown in FIG. 8.

If the proportional component Wp has exceed the threshold value εj (the proportional component Wp is greater than the threshold value εj) and it is judged that an abnormality has occurred to the movement of the carriage 17, the above-mentioned abnormality judging part Pr2 sends a stop instruction to the carriage driving part 87, and upon receiving the stop instruction, the carriage driving part 87 stops the carriage motor M2 to stop the carriage 17. Then, the controller 80 shows a prescribed display on the display part of the operation panel 43 (FIG. 2) to notify the user of the inkjet printer 10 that an abnormality has occurred to the movement of the carriage 17.

Subsequently, the controller 80 moves the carriage 17 to the home position or the retreat position, ends the process, and waits for the user of the inkjet printer 10 to remove the cause of the abnormality occurrence and release the abnormality in the movement of the carriage 17.

On the other hand, if the proportional component Wp has not exceeded the threshold value εj (the proportional component Wp is equal to or smaller than the threshold value εj) and it is judged that no abnormality has occurred to the movement of the carriage 17, the above-mentioned control value calculating part Pr1 reads and acquires the feedforward control value Wf from the setting value storing part 83.

The above-mentioned feedforward control value Wf is a control value that combines the acceleration corresponding control value Wα and the velocity corresponding control value Wv. The value Wα is a control value that is set based on a variation amount of the target acceleration, and corresponds to the acceleration component. The value Ww is another control value that is set based on the target velocity Vs, and corresponds to the velocity component. The acceleration corresponding control value Wα and the velocity corresponding control value Wv are independently recorded in the setting value storing part 83.

Then, the above-mentioned acceleration corresponding control value Wα is used in the acceleration region Ar1 and the deceleration region Ar3, and the velocity corresponding control value Wv is used in the acceleration region Ar1, the uniform velocity region Ar2, and the deceleration region Ar3.

Therefore, the feedforward control value Wf is expressed as $$Wf=W\alpha+Wv$$

in the acceleration region Ar1 and the deceleration region Ar3, and as $$Wf=Wv$$

in the uniform velocity region Ar2.

The acceleration corresponding control value Wα linearly increases at a constant slope in the first acceleration region portion, becomes a constant value in the second acceleration portion, and linearly decreases at a constant slope in the third acceleration region portion of the acceleration region Ar1. Also, the acceleration corresponding control value Wα linearly decreases at a constant slope in the first deceleration region portion, becomes a constant value in the second deceleration portion, and linearly increases at a constant slope in the third deceleration region portion of the deceleration region Ar3.

In this embodiment, the acceleration corresponding control value Wα is set corresponding to the variation amount of the target acceleration, that is, a jerk that is a value calculated by differentiating the target acceleration, and consists of a part where the jerk takes a positive value, a part where it takes 0, and a part where it takes a negative value.

Note that although the target velocity Vs is set to draw a curve in the first and the third acceleration region portions of the acceleration region Ar1 and the first and the third deceleration region portions of the deceleration region Ar3 in this embodiment, it can be set not to draw a curve in the acceleration region Ar1 and the acceleration region Ar3. In that case, it is preferred to set the acceleration corresponding control value Wα so that the jerk takes a negative value in a part immediately before shifting from the acceleration region Ar1 to the uniform velocity region Ar2, and a part immediately after shifting from the uniform velocity region Ar2 to the deceleration region Ar3.

Also, the velocity corresponding control value Wv is set corresponding to the target velocity Vs so as to draw a curve in the first and the third acceleration region portions of the acceleration region Ar1 and the first and the third deceleration region portions of the deceleration region Ar3, and draw a line in the second acceleration region portion of the acceleration region Ar1 and the second deceleration region portion of the deceleration region Ar3.

That is, the velocity corresponding control value Wv has its positive slope gradually increased in the first acceleration region portion, its positive slope kept constant in the second acceleration region portion, and its positive slope gradually decreased in the third acceleration region portion of the acceleration region Ar1 of the target velocity Vs, and once a shift occurs from the acceleration region Ar1 to the uniform velocity region Ar2, its value is kept constant.

Then, the negative slope is gradually increased in the first deceleration region portion, the negative slope is kept constant in the second deceleration region portion, and the negative slope is gradually decreased to make the value 0 in the third deceleration region portion of the deceleration region Ar3 of the target velocity Vs.

Next, the above-mentioned control value calculating part Pr1 calculates the total control value Wt based on the feedback control value Wb and the feedforward control value Wf.

Subsequently, the controller 80 sends the total control value Wt to the carriage driving part 87. Upon receiving the total control value Wt, the carriage driving part 87 has a PWM control signal generated according to the total control value Wt in the above-mentioned pulse width modulation signal generating part, has current generated according to the duty of the PWM control signal in the above-mentioned switching circuit, and sends the current to the carriage motor M2 to drive the carriage motor M2.

Then, the controller 80 judges whether one scan is finished, if one scan is not finished, sets the next scan and acquires the actual position of the carriage 17 again, and if one scan is finished, ends printing one line and places the carriage 17 at the starting point Ps.

As the result, the occurrences of delays in the actual position relative to the target position and in the actual velocity Vr relative to the target velocity Vs can be suppressed, therefore trackability to the target velocity Vs can be improved.

Also, because movement control of the carriage 17 is performed using both feedback control and feedforward control, and the feedforward control value Wf is not set to a constant value such as an offset value but consists of the acceleration corresponding control value Wα and the velocity corresponding control value Wv, the feedforward control value Wf can be easily changed according to the elapsed time while the carriage 17 is moved from the starting point Ps to the ending point Pe.

For example, if there is a region where the carriage 17 is desired to be rapidly accelerated or rapidly decelerated, or the actual velocity Vr is desired to be smoothly changed, by setting the acceleration component control value Wα in a prescribed pattern, the deviation δV between the target velocity Vs and the actual velocity Vr can be reduced. As the result, the occurrences of delays in the actual position relative to the target position and in the actual velocity Vr relative to the target velocity Vs can be suppressed, therefore trackability of the control can be improved.

Also, because the target acceleration a is set to 0 at the timing of shifting from the acceleration region Ar1 to the uniform velocity region Ar2, the total control value Wt needs to be rapidly reduced. However, in this embodiment, because the acceleration corresponding control value Wα is reduced in the third acceleration region portion of the acceleration region Ar1 and the first deceleration region portion of the deceleration region Ar3, variation of the feedback control value Wb can be reduced, therefore variation of the total control value Wt can be reduced.

As the result, because the actual velocity Vr of the carriage 17 can be prevented from varying greatly, there is no waiting region formed for waiting until it becomes possible to eject ink droplets from the recording heads Hi, allowing an improvement in the printing throughput.

Furthermore, because the velocity corresponding control value Wv changes drawing a curve immediately before the target velocity Vs shifts from the acceleration region Ar1 to the uniform velocity region Ar2 and immediately after it shifted from the uniform velocity region Ar2 to the deceleration region Ar3, the peak value Wpmax of the proportional component Wp in the acceleration region Ar1 and the peak value Wpmin of the proportional component Wp in the deceleration region Ar3 can be reduced, and also variation of the proportional component Wp when shifting from the acceleration region Ar1 to the uniform velocity region Ar2 and variation of the proportional component Wp when shifting from the uniform velocity region Ar2 to the deceleration region Ar3 can be reduced.

Next, explained is the flow chart.

S1: The controller 80 acquires the actual position of the carriage 17.

S2: The controller 80 acquires time.

S3: The controller 80 acquires the actual velocity Vr of the carriage 17.

S4: The control value calculating part Pr1 calculates the feedback control value Wb.

S5: The abnormality judging part Pr2 compares proportional component Wp with the threshold value εj.

S6: The abnormality judging part Pr2 judges whether an abnormality has occurred to the movement of the carriage 17. Specifically, it is determined if proportional component Wp is larger than threshold value εj. If an abnormality has occurred to the movement of the carriage 17, it proceeds to S7, and if no abnormality has occurred to the movement of the carriage 17, it proceeds to S9.

S7: The carriage driving part 87 stops the carriage 17.

S8: The controller 80 moves the carriage 17 to the home position or the retreat position, and ends the process.

S9: The control value calculating part Pr1 acquires the feedforward control value Wf.

S10: The control value calculating part Pr1 calculates the total control value Wt.

S11: The carriage driving part 87 drives the carriage motor M2.

S12: The controller 80 judges whether one scan is completed. If one scan is completed, it ends the process, and if one scan is not finished, proceeds to S13.

S13: The controller 80 sets the next scan and returns to S1.

Next, explained are changes in the proportional component Wp if no abnormality has occurred to the movement of the carriage 17 or if an abnormality has occurred to the movement of the carriage 17 while performing movement control of the carriage 17 using both feedback control and feedforward control in this embodiment.

Figure 9:
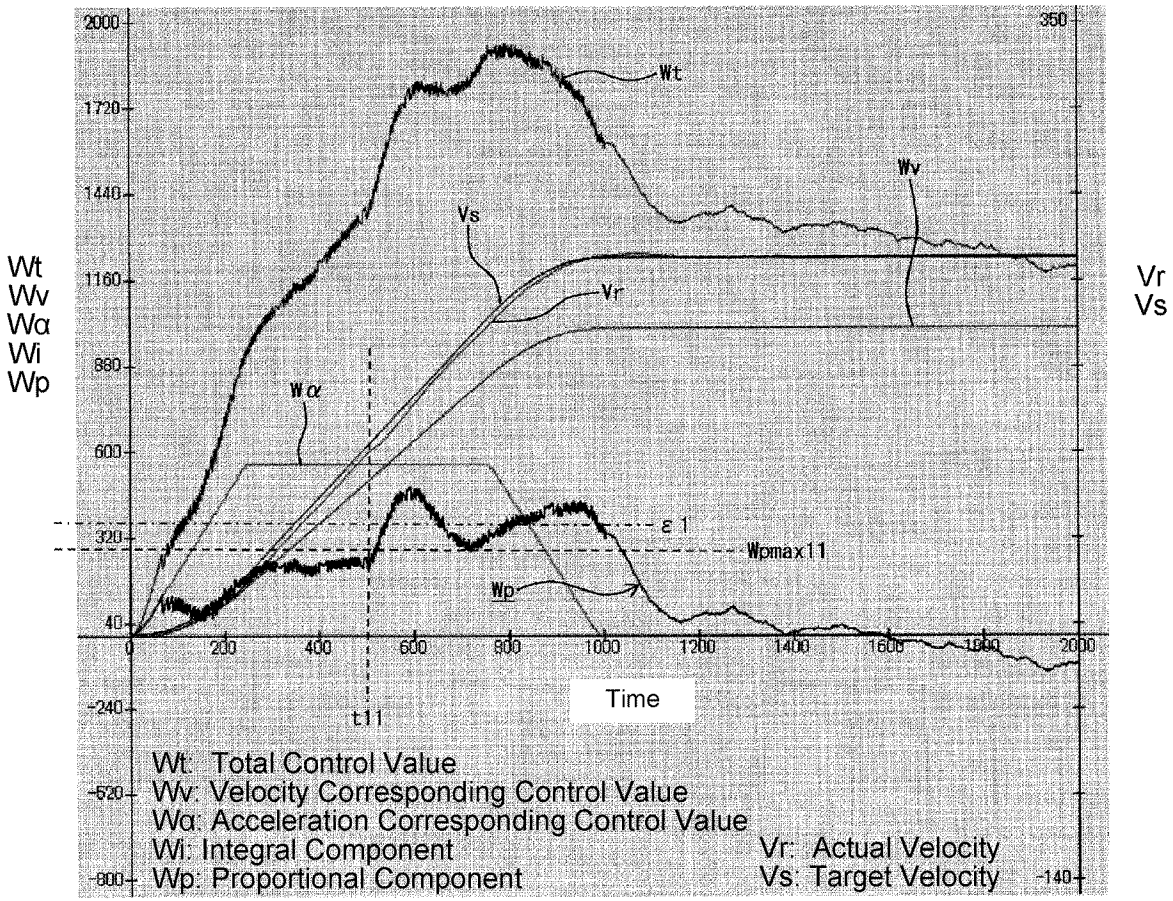
FIG. 9 is a time chart for explaining the operation of the inkjet printer if an abnormality has occurred to the carriage movement while performing carriage movement control in the embodiment of this invention.

FIG. 8 is a time chart for explaining the operation of the inkjet printer if no abnormality has occurred to the carriage movement while performing carriage movement control in the embodiment of this invention, and FIG. 9 is a time chart for explaining the operation of the inkjet printer if an abnormality has occurred to the carriage movement while performing carriage movement control in the embodiment of this invention. Note that in the figures, the horizontal axis indicates time (unit: ms), the left vertical axis the proportional component Wp, the integral component Wi, the acceleration corresponding control value Wα, the velocity corresponding control value Wv, and the total control value Wt, and the right vertical axis the target velocity Vs and the actual velocity Vr. Also, the proportional component Wp, the integral component Wi, the acceleration corresponding control value Wα, the velocity corresponding control value Wv, the total control value Wt, and the target velocity Vs and the actual velocity Vr of the carriage 17 are dimensionless quantities.

In the figures, denoted as Vs is the target velocity, Vr is the actual velocity, Wp is the proportional component, Wt is the total control value, Wα is the acceleration corresponding control value, and Wv is the velocity corresponding control value. The proportional component Wp is calculated based on the deviation between the target position and the actual position, the deviation δV between the target velocity Vs and the actual velocity Vr, the gain, etc.

In this embodiment, as mentioned above, because the deviation between the target position and the actual position and the deviation δV between the target velocity Vs and the actual velocity Vr can be reduced in the acceleration region Ar1 and the deceleration region Ar3, the proportional component Wp can be reduced.

Also, variation of the proportional component Wp when the target velocity Vs shifts from the acceleration region Ar1 to the uniform velocity region Ar2, and variation of the proportional component Wp when it shifts from the uniform velocity region Ar2 to the deceleration region Ar3 can be reduced.

Therefore, in the acceleration region Ar1, the uniform velocity region Ar2, and the deceleration region Ar3, the threshold value εj can be set small to the extent that it is not misjudged whether an abnormality has occurred to the movement of the carriage 17, considering scatters among different units of the inkjet printer 10.

When the target velocity Vs in the acceleration region Ar1, and if no abnormality has occurred to the movement of the carriage 17, as shown in FIG. 8, the proportional component Wp gradually increases according to delays occurring in the actual position and the actual velocity Vr, and after reaching a peak value Wpmax11, gradually decreases. In this case, because the peak value Wpmax11 never exceeds a threshold value ε1, it is never judged that an abnormality has occurred to the movement of the carriage 17.

Also, in the uniform velocity region Ar2, because a peak value Wpmax12 of the proportional component Wp is lower than the peak value Wpmax11, a threshold value ε2 is set smaller than the threshold value ε1.

As opposed to this, as shown in FIG. 9, if an abnormality has occurred to the movement of the carriage 17 at timing t11, the actual velocity Vr of the carriage 17 decreases, the deviation δV increases, and accompanying it, the proportional component Wp increases and exceeds the threshold value ε1.

At this time, even if the abnormality in the movement of the carriage 17 is small to the extent that the recording medium is distorted and slightly touches the carriage, if the delay in the actual velocity Vr relative to the target velocity Vs of the carriage 17 increases even slightly, it is judged that an abnormality has occurred to the movement of the carriage 17.

In this manner, in this embodiment, because movement control of the carriage 17 is performed using both feedback control and feedforward control, the feedback control value Wb can be reduced, and the proportional component Wp can be reduced.

Therefore, in judging whether the proportional component Wp has exceeded the threshold value εj, because the threshold value εj can be reduced, even if the abnormality in the movement of the carriage 17 is small, it can be securely judged whether the proportional component Wp has exceeded the threshold value εj.

As the result, it can be accurately judged whether an abnormality has occurred to the movement of the carriage 17.

Then, because there will be no case where an image is formed on the recording medium without judging that an abnormality has occurred to the movement of the carriage 17, degradation in the image quality can be prevented.

Also, because the above-mentioned threshold value εj is set according to the peak value of the proportional component Wp for each of the acceleration region Ar1, the uniform velocity region Ar2, and the deceleration region Ar3, it can be even more accurately judged whether an abnormality has occurred to the movement of the carriage 17.

Furthermore, in this embodiment, as mentioned above, because the target velocity Vs changes so as to draw a curve in the first and the third acceleration region portions of the acceleration region Ar1 and the first and the third deceleration region portions of the deceleration region Ar3, the deviation δV between the target velocity Vs and the actual velocity Vr can be reduced, and the proportional component Wp can be reduced.

Therefore, it can be accurately judged whether an abnormality has occurred to the movement of the carriage 17.

Furthermore, in this embodiment, as mentioned above, because the acceleration corresponding control value Wα is reduced in the third acceleration region portion of the acceleration region Ar1 and the first deceleration region portion of the deceleration region Ar3, variation of the feedback control value Wb can be reduced, and variation of the proportional component Wp can be reduced.

Therefore, it will never be misjudged that an abnormality has occurred to the movement of the carriage 17.

Also, in this embodiment, as mentioned above, because the velocity corresponding control value Wv changes drawing a curve immediately before the target velocity Vs shifts from the acceleration region Ar1 to the uniform velocity region Ar3 and immediately after it shifted from the uniform velocity region Ar2 to the deceleration region Ar3, the proportional component Wp in the acceleration region Ar1 and the deceleration region Ar3 can be reduced, and also variation of the proportional component Wp when shifting from the acceleration region Ar1 to the uniform velocity region Ar2 and shifting from the uniform velocity region Ar2 to the deceleration region Ar3 can be reduced.

Therefore, it can be accurately judged whether an abnormality has occurred to the movement of the carriage 17, and there will be no misjudgment that an abnormality has occurred to the movement of the carriage 17.

In this embodiment, the proportional component Wp and the integral component Wi are calculated based on the deviation between the target position and the actual position and the deviation δV between the target velocity Vs and the actual velocity Vr of the carriage 17, the gain, etc. However, they can be calculated based on the deviation between the target position and the actual position, the gain, etc., or based on the deviation δV between the target velocity Vs and the actual velocity Vr, the gain, etc.

Also, the proportional component Wp and the integral component Wi can be calculated having as parameters the deviation between the target position and the actual position, and the deviation δV between the target velocity Vs and the actual velocity Vr. In this case, if those two parameters are assigned with prescribed weights in calculating the proportional component Wp and the integral component Wi, trackability to the target velocity Vs can be further improved.

Note that this invention is not limited to the above-mentioned embodiment but can be modified in various kinds of manners based on the purpose of this invention, and they are not excluded from the scope of this invention. Especially, the total control value Wt, feedback control value Wb, feedforward control value Wf are not limited by the disclosed components above. In view of conventional control technology, various types of components are available to compose these values. Also, proportional component Wp, integral component Wi, velocity and acceleration corresponding control values Wv and Wα are not limited within the above embodiments. In the light of conventional technologies, various components including velocity and acceleration are available.

In the invention, the target values, thresholds (or threshold values) and feedforward control values are determined in advance (or prior to the image forming process) from experiences under various conditions or try and error experiences. For example, when moving the carriage from one end of the reciprocation area, the one end is used as a staring point and an elapsed time counts after the carriage leaves form the starting point. The elapsed time is segmented with a predetermined interval so that many measured points are created. A velocity of the carriage is measured at each of the measured points, making the velocity the target value at the measured point. The velocity is illustrated as a line with Vs. The predetermined interval may be ranged within 0.001 to 0.1 seconds.

The threshold values are determined through experiences in which a carriage is caused to collide against a sheet as the control values change. In these experiences, it is observed whether or not any deficiency occurs. When an inacceptable control value is found, the value or near value may be used as the threshold value.

The feedforward control values are determined through many experiences that are performed under various value Wα. When a value Wα that is following well to the target is found, such a value may be used as the feedforward control value.

These above three values are determined at each of the measured points, the points being repeatedly disposed and separated one another with an interval. As described above, the interval may be based on an elapsed time (or a time unit that is obtained based on a measured time), but it may be based on a travel distance (or a moving distance unit) for which the carriage moves from the starting point.

What is claimed is:

1. An inkjet printer, comprising:

a carriage motor that moves a carriage, a carriage driving part that drives the carriage motor, a control value calculating part that calculates a total control value (Wt) composed with a control value for a feedback control and a control value for a feedforward control, which are respectfully referred as a feedback control value (Wb) and a feedforward control value (Wf), and an abnormality judging part that judges whether an abnormality has occurred to the carriage movement based on whether a proportional component (Wp) of the feedback control, value has exceeded a threshold value, wherein the threshold value is set for each of an acceleration region, a uniform velocity region, and a deceleration region that are categorized according to changes in a target velocity of the carriage, and the control value for the feedforward control is a value combining a control value corresponding to an acceleration component and a control value corresponding to a velocity component, which are respectively referred as an acceleration corresponding control value (Wα) and a velocity corresponding control value (Wv).

2. The inkjet printer according to claim 1, wherein the threshold value in the uniform velocity region is set smaller than the threshold value in the acceleration region.

3. The inkjet printer according to claim 1, wherein the acceleration corresponding control value is used in the acceleration region and the deceleration region, and the velocity corresponding control value is used in the acceleration region, the uniform velocity region, and the deceleration region.

4. The inkjet printer according to claim 1, wherein the acceleration corresponding control value is set corresponding to a variation amount in a target acceleration of the carriage.

5. The inkjet printer according to claim 1, wherein the velocity corresponding control value changes in a fashion of drawing a curve immediately before the target velocity shifts from the acceleration region to the uniform velocity region and immediately after it shifts from the uniform velocity region to the deceleration region.

6. A movement control method for a carriage, wherein calculating a total control value consisting of a control value for feedback control and a control value for feedforward control, supplying the total control value to a carriage driving part, driving a carriage motor, and moving the carriage, and judging whether or not an abnormality has occurred to the carriage movement based on whether a proportional component of the control value for feedback control has exceeded a threshold value, wherein the threshold value is set for each of an acceleration region, a uniform velocity region, and a deceleration region that are categorized according to changes in a target velocity of the carriage, and the control value for the feedforward control is a value combining a control value corresponding to an acceleration component and a control value corresponding to a velocity component, which are respectively referred as an acceleration corresponding control value (Wα) and a velocity corresponding control value (Wv).

7. An inkjet printer that performs an image forming process by moving a carriage, comprising:

a controller that is connected to a carriage motor and controls a movement of the carriage in a reciprocation area (Ar1 to Ar3) with the carriage motor such that the carriage reciprocates between two ends of the reciprocation area, a control value calculating part that calculates a total control value (Wt) for the movement of the carriage, a carriage detection part that detects a status of the carriage and obtains a measured value of the carriage in correspondence with the status, the measured value being sent to the control value calculating part, a setting value storing part that stores target values, feedforward control values and a threshold value of the carriage, which are determined with a predetermined interval through the reciprocation area in advance, wherein the controller controls the movement of the carriage using the total control value, which is composed with a feedback control value (Wb) and one of the feedforward control values (Wf), the feedback control value being obtained from a deviation, which is a difference between the measured value detected by the carriage detection part and one of the target values, which corresponds to the measured value, the feedback control value being composed with a proportional component (Wp) and integral component (Wi), and the one of the feedforward control values being selected from the setting value storing part based on the status of the carriage, the controller further determines whether or not the proportional component of the feedback control value exceeds the threshold value, when exceeding, the controller stops the image forming process, and causes the carriage to retreat from the reciprocation area, and when not exceeding, the controller continues the image forming process, the measured value includes a position, a travel time, and an actual velocity of the carriage, which are measured with the carriage detection part, the position meaning where the carriage is located in the reciprocation area at a measuring moment, the travel time meaning a period that has been counted since the carriage departs from one of the ends of the reciprocation area, the actual velocity being measured at the measuring moment, the one of the target values, which corresponds to the measured value, includes a target velocity and a target acceleration, and the predetermined interval, which is used to determine the target values and feedforward control values, is determined by either a time unit that is obtained based on a measured time or a moving distance unit that is obtained based on a distance for which the carriage moves.

8. The inkjet printer of claim 7, wherein the reciprocation area is composed with three regions, which are an acceleration region (Ar1), a uniform velocity region (Ar2) and a deceleration region (Ar3) wherein the uniform velocity region intervenes between the acceleration and deceleration regions, in the acceleration region, a velocity of the carriage increases, in the uniform velocity region, the velocity of the carriage is constant, in the deceleration region, the velocity of the carriage decrease, the threshold value stored in the setting value storing part is composed with three thresholds (ε1 to ε3), which respectively correspond to the three regions, when the carriage is in the acceleration region, the controller selects and compares the threshold (ε1) of the acceleration region with the proportional component, when the carriage is in the uniform velocity region, the controller selects and compares the threshold (ε2) of the uniform velocity region with the proportional component, when the carriage is in the deceleration region, the controller selects and compares the threshold (ε3) of the deceleration region with the proportional component.

9. The inkjet printer of claim 8, wherein the threshold (ε2) of the constant velocity region is smaller than those (ε1 and ε3) of the acceleration and deceleration regions.

10. The inkjet printer of claim 7, wherein the reciprocation area is composed with three regions, which are an acceleration region (Ar1), a uniform velocity region (Ar2) and a deceleration region (Ar3) wherein the uniform velocity region intervenes between the acceleration and deceleration regions, in the acceleration region, a velocity of the carriage increases, in the uniform velocity region, the velocity of the carriage is constant, in the deceleration region, the velocity of the carriage decrease, and the feedforward control value is composed with an acceleration corresponding control value (Wα), which is based on a deviation of the target acceleration, and a velocity corresponding control value (Wv), which is based on a deviation of the target velocity, the total control value (Wt) is obtained with follows:

in the acceleration and deceleration regions, Wt=Wb+Wv+Wα in the uniform velocity region, Wt=Wb+Wv.

11. The inkjet printer of claim 10, wherein an increasing proportion of the velocity corresponding control value (Wv) in the acceleration region becomes smaller as approaching the uniform velocity region, and a decreasing proportion of the velocity corresponding control value (Wv) in the deceleration region becomes larger as parting from the uniform velocity region.

* * * * *